United States Patent [19]

Gallacci

[11] 4,071,021

[45] Jan. 31, 1978

[54] MECHANICAL BACK SCRATCHER

[75] Inventor: Joe Gallacci, Ukiah, Calif.

[73] Assignee: The Raymond Lee Organization, Inc., a part interest

[21] Appl. No.: 704,441

[22] Filed: July 12, 1976

[51] Int. Cl.[2] ..... A61H 7/00

[52] U.S. Cl. ..... 128/52; 128/62 R

[58] Field of Search ..... 128/62 R, 65, 52, 24.2, 128/51, 56; 4/184

[56] References Cited

U.S. PATENT DOCUMENTS

| | | | |
|---|---|---|---|
| 158,877 | 1/1875 | Woolsey | 4/184 |
| 1,712,521 | 5/1929 | Rothchild et al. | 4/184 |
| 2,004,428 | 6/1935 | Davies | 128/51 |
| 2,378,471 | 6/1945 | Dixon | 4/184 |
| 2,730,737 | 1/1956 | Herman | 4/184 X |
| 3,517,235 | 6/1970 | Flowers et al. | 128/62 R |
| 3,802,421 | 4/1974 | Williams | 128/56 |
| 3,896,796 | 7/1975 | Soderblom | 128/65 |

FOREIGN PATENT DOCUMENTS

| | | | |
|---|---|---|---|
| 203,395 | 10/1908 | Germany | 4/184 |

*Primary Examiner*—Lawrence W. Trapp

[57] ABSTRACT

Two vertically elongated shafts are mounted parallel to a wall, and are driven by a motor-powered mechanism that moves the shafts up and down in simple harmonic motion. Any one of a plurality of scratching attachments can be detachably secured between the ends of the shafts.

1 Claim, 4 Drawing Figures

MECHANICAL BACK SCRATCHER

BACKGROUND OF THE INVENTION

Many devices for mechanically scratching the backs of the individuals that use them are known. The most pertinent of these are exemplified by U.S. Pat. Nos. 992,905 and 1,965,774. This device, like those, is designed primarily for use in bathrooms, near showers and the like. However, the specific structure of this device is substantially different from the structures taught in the devices cited above.

SUMMARY OF THE INVENTION

In this device, a pair of parallel, vertically elongated shafts are are mounted parallel to a bathroom wall. A motor-driven device moves the shafts up and down together as a unit, in simple harmonic motion. Any one of a collection of scratching attachments can be detachably secured between the ends of the shafts, depending upon the abrasiveness of the scratching that is desired.

DETAILED DESCRIPTION OF PREFERRED EMBODIMENTS

Figure 1:
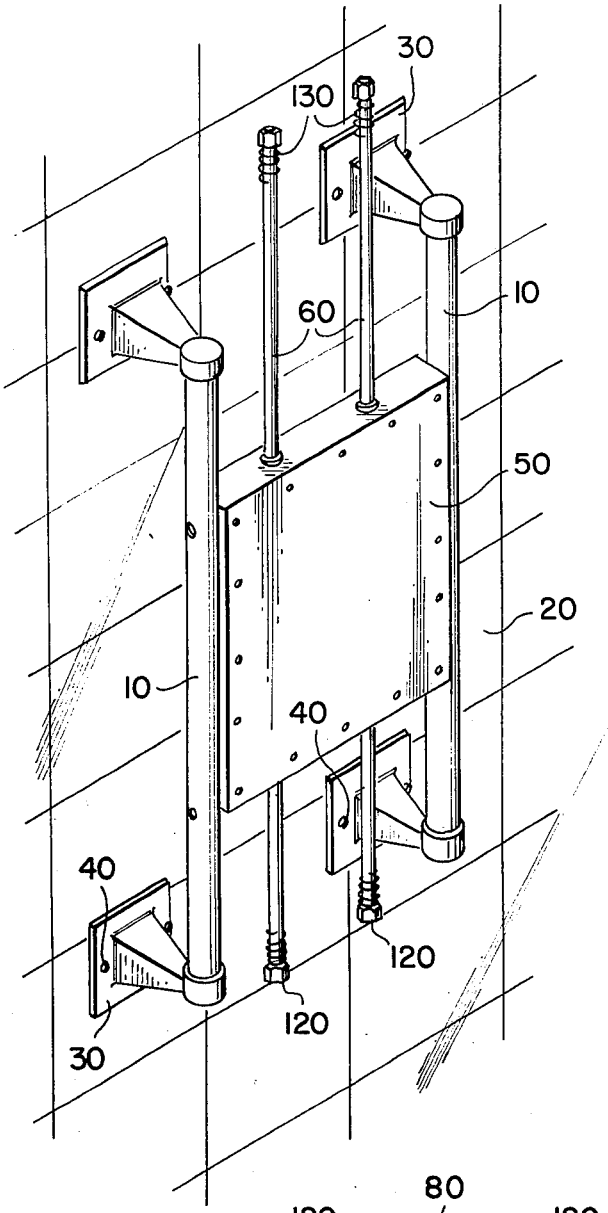
FIG. 1 shows the invention without a scratching attachment mounted on it.
Figure 2:
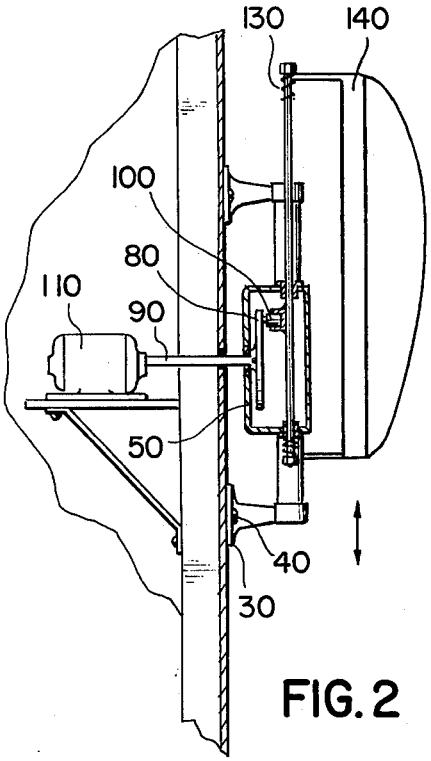
FIG. 2 shows how a scratching attachment can be secured to the shafts.
Figure 3:
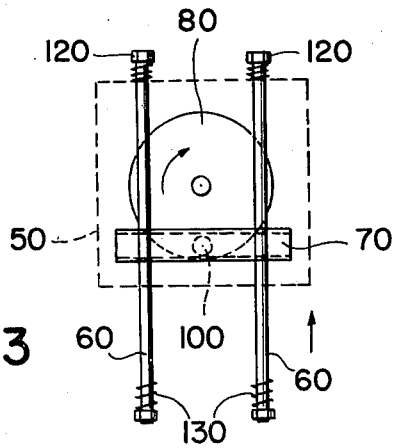
FIGS. 3 and 4 show how the mechanical linkage in the invention operates.
Figure 4:
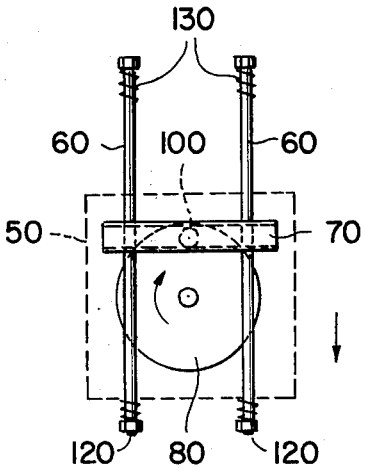

Two vertically elongated pillars 10 are secured parallel to bathroom wall 20 and each other by wall brackets 30 secured to the wall by screws 40 and located at the ends of the pillars. Between the pillars is located a rectangular, bar-shaped housing 50 which is closed at the front and has a hole at the back.

Two parallel, vertically elongated shafts 60 are mounted in holes in the housing, and can move up and down in the holes in a plane parallel to the surface of the wall. A horizontal track 70 which is U-shaped in cross-section with the open end of the U facing rearwardly is attached between the shafts behind the housing so that the ends of the shafts are aligned and so that the shafts move together as a unit.

A disc 80 is mounted inside the housing, so as to rotate with shaft 90 in a vertical plane parallel to the wall. A stud 100 extends forwardly from the front surface of the disc and engages the track. Shaft 90 extends through the hole in the rear of the housing and is driven by motor 110 mounted upon the opposite side of the wall. It can be seen that as the disc is rotated by the motor, the stud will move back and forth in the track while the track is itself moved up and down. Thus, the shafts will move up and down in the housing, executing simple harmonic motion, as long as the motor operates at variable speed. Nuts 120 at the ends of the shafts abut compression springs 130 which are wrapped around the shafts and attached to them.

Any one of a plurality of scratching attachments 140 can be mounted between the ends of the springs and the nuts. This means of connection allows the attachment in question to be easily attached and removed from the shafts. Attachments which have been found to give satisfactory abrasiveness are characterized by a vertically elongated covering surface of terry cloth or a brush including a plurality of bunches of bristles.

What is claimed is:

1. A back scratcher for use with a vertical wall and comprising:

first and second vertical spaced parallel bars disposed in front of the wall and secured thereto in fixed position;

a vertical hollow housing disposed between the bars and secured thereto;

first and second vertical spaced parallel shafts disposed between the bars extending slidably through the housing, the top ends of the shafts being disposed above the housing, the bottom ends of the shafts being disposed below the housing, said shafts being movable vertically in their axial direction between a raised position and a lowered position at which the top ends of the shaft approach the housing;

four coil springs, each spring being disposed concentrically about a corresponding shaft adjacent a corresponding end thereof, said springs being disposed outside of the housing;

a horizontal track secured to both shafts and disposed inside the housing at the rear of the shafts, said track having a rear disposed horizontal groove;

a rotatable vertical disc in the housing at the rear of the track;

a horizontal stud secured at one end to the disc in an off center position, the other end of the stud engaging said groove;

an electric motor disposed at the rear of the housing and having a horizontal drive shaft extending into said housing and secured to the center of the disc whereby rotation of the drive shaft imparts vertical reciprocating motion to said vertical shafts; and scratching means secured between the ends of the vertical shafts.

* * * * *